US007456799B1

(12) United States Patent
Cohen

(10) Patent No.: US 7,456,799 B1
(45) Date of Patent: Nov. 25, 2008

(54) WIDEBAND VEHICULAR ANTENNAS

(75) Inventor: Nathan Cohen, Belmont, MA (US)

(73) Assignee: Fractal Antenna Systems, Inc., Waltham, MA (US)

( * ) Notice: Subject to any disclaimer, the term of this patent is extended or adjusted under 35 U.S.C. 154(b) by 64 days.

(21) Appl. No.: 11/805,472

(22) Filed: May 22, 2007

Related U.S. Application Data

(63) Continuation-in-part of application No. 11/716,909, filed on Mar. 12, 2007, which is a continuation of application No. 10/812,276, filed on Mar. 29, 2004, now Pat. No. 7,190,318.

(60) Provisional application No. 60/458,333, filed on Mar. 29, 2003, provisional application No. 60/802,498, filed on May 22, 2006.

(51) Int. Cl.
*H01Q 13/00* (2006.01)

(52) U.S. Cl. ..... 343/773; 343/846

(58) Field of Classification Search ..... 343/773, 343/772, 846
See application file for complete search history.

(56) References Cited

U.S. PATENT DOCUMENTS

| | | | | |
|---|---|---|---|---|
| 3,115,630 | A | 12/1963 | Lanford | |
| 3,656,166 | A | 4/1972 | Klopach et al. | |
| 3,829,863 | A | 8/1974 | Lipsky | |
| 3,987,456 | A | 10/1976 | Gelin | |
| 4,143,377 | A | 3/1979 | Salvat et al. | |
| D284,965 | S * | 8/1986 | Nakamura | D14/233 |
| 4,851,859 | A | 7/1989 | Rappaport | |
| 5,028,928 | A | 7/1991 | Vidmar et al. | |
| 5,345,238 | A | 9/1994 | Eldridge et al. | |
| 5,523,767 | A | 6/1996 | McCorkle | |
| 5,600,340 | A * | 2/1997 | Ho et al. | 343/846 |
| 6,140,975 | A | 10/2000 | Cohen | |
| 6,198,454 | B1 * | 3/2001 | Sharp et al. | 343/773 |
| 6,593,892 | B2 * | 7/2003 | Honda et al. | 343/773 |
| 7,286,095 | B2 | 10/2007 | Parsche et al. | |
| 7,339,542 | B2 * | 3/2008 | Lalezari | 343/773 |
| 7,352,334 | B2 | 4/2008 | Kuroda et al. | |

OTHER PUBLICATIONS

Syntony and Spark, H. Aitkin, Princeton (1985), p. 133.

* cited by examiner

*Primary Examiner*—Tho G Phan
(74) *Attorney, Agent, or Firm*—McDermott Will & Emery LLP

(57) ABSTRACT

Antennas suitable for wideband transmission and reception are disclosed that are useful in environments susceptible to vibration and impact motion such as for example vehicles of various types, e.g., automobiles, trains, etc. The apparatus can include a bicone antenna including two cone-shaped elements. The physical shape of at least one of the two cone-shaped elements may be at least partially defined by one or more pleats (e.g., a series) that extend about a portion of the cone. An antenna can further includes a mast for supporting the bicone as well as a second antenna section including a fractalized dipole. The fractalized dipole can be configured as a conformal circuit board conforming to the shape of the mast and can include self-similar portions or extensions. The antenna may also include a counterpoise to balance the electrically conductive conformal portion. The counterpoise may be defined substantially by a repetitive tooth-like pattern.

14 Claims, 7 Drawing Sheets

WIDEBAND VEHICULAR ANTENNAS

RELATED APPLICATIONS

This application is a continuation-in-part of U.S. application Ser. No. 11/716,909 filed Mar. 12, 2007, which in turn is a continuation of U.S. application Ser. No. 10/812,276, filed Mar. 29, 2004 now U.S. Pat. No. 7,190,318 which application claims priority to U.S. Provisional Application No. 60/458,333, filed Mar. 29, 2003, all of which applications are incorporated herein by reference in their entireties. This application further claims priority to U.S. Provisional Application No. 60/802,498 filed 22 May 2006, the content of which is incorporated herein by reference in its entirety. This application is also related to U.S. application Ser. No. 10/868,858, filed Jun. 17, 2004, now issued as U.S. Pat. No. 7,126,531, and U.S. application Ser. No. 09/700,005, filed Nov. 7, 2000, now issued as U.S. Pat. No. 6,445,352, the contents of both of which applications are incorporated herein by reference in their entireties.

BACKGROUND

Antennas are used to typically radiate and/or receive electromagnetic signals, preferably with antenna gain, directivity, and efficiency. Practical antenna design traditionally involves trade-offs between various parameters, including antenna gain, size, efficiency, and bandwidth.

Antenna design has historically been dominated by Euclidean geometry. In such designs, the closed area of the antenna is directly proportional to the antenna perimeter. For example, if one doubles the length of an Euclidean square (or "quad") antenna, the enclosed area of the antenna quadruples. Classical antenna design has dealt with planes, circles, triangles, squares, ellipses, rectangles, hemispheres, paraboloids, and the like.

With respect to antennas, prior art design philosophy has been to pick a Euclidean geometric construction, e.g., a quad, and to explore its radiation characteristics, especially with emphasis on frequency resonance and power patterns. Unfortunately antenna design has concentrated on the ease of antenna construction, rather than on the underlying electromagnetics, which can cause a reduction in antenna performance.

Practical antenna design traditionally involves trade-offs between various parameters, including antenna gain, size, efficiency, and bandwidth. Antenna size is also traded off during antenna design that typically reduces frequency bandwidth. Being held to particular size constraints, the bandwidth performance for antenna designs such as discone and bicone antennas is sacrificed resulted in reduced bandwidth.

In general, a wideband requirement for an antenna, especially a dipole-like antenna, has required a bicone or discone shape to afford the performance desired over a large pass band. For example, some pass bands desired exceed 3:1 as a ratio of lowest to highest frequencies of operation, and typically ratios of 20:1 to 100:1 are desired. Referring to FIG. 1, prior art discone antenna 5 includes a sub-element 10 shaped as a cone whose apex is attached to one side of a feed system at location 20. A second sub-element 30 is attached to the other side of the feed system, such as the braid of a coaxial feed system. This sub-element is a flat disk meant to act as a counterpoise.

Referring to FIG. 2, another current antenna design is depicted that includes a bicone antenna 35, in which a sub-element 40 is arranged similar to sub-element 10 shown the discone antenna 5 of FIG. 1 with a similar feed arrangement at location 50. However, for bicone antenna 35 rather than a second sub-element shaped as a disk, a second cone 60 is attached.

Both discone and bicone antennas afford wideband performance often over a large ratio of frequencies of operation; in some arrangements more than 10:1. However, such antennas are often ¼ wavelength across, as provided by the longest operational wavelength of use, or the lowest operating frequency. In height, the discone is typically ¼ wavelength and the bicone almost ¼ wavelength of the longest description when read together with the accompanying drawings, which are to be regarded as illustrative in nature, and not as limiting. The drawings are not necessarily to scale, emphasis instead being placed on the principles of the disclosure. In the drawings:

FIG. 1 FIG. 1 depicts a conventional discone antenna;

FIG. 2 depicts a conventional bicone antenna;

FIG. 3 depicts a conventional shorted discone antenna;

FIG. 4 depicts a cutaway diagram of an accordioned bicone antenna according to an embodiment of the present disclosure;

FIG. 5 depicts an enlarged view of the bicone assembly of FIG. 4;

FIG. 6 depicts a fractalized circuit board according to a further embodiment; and FIG. 7 is a picture of an exemplary embodiment of an antenna constructed in accordance with the present disclosure.

While certain embodiments are shown in the drawings, one skilled in the art will appreciate that the embodiments depicted in the drawings are illustrative and that variations of those shown, as well as other embodiments described herein, may be envisioned and practiced within the scope of the present disclosure.

DETAILED DESCRIPTION

Embodiments of the present disclosure are directed to wideband antennas and related systems and techniques. Such antennas can include an accordioned bicone antenna, e.g., for frequencies from VHF to microwave, and a fractalized dipole, e.g., for lower frequencies. In exemplary embodiments, the fractalized dipole can include a circuit board with a trace at least a portion of which is self similar for at least two iterations. The circuit board can be conformal inside of a tube or mast structure, operational wavelength. Typically, when the lowest operational frequency corresponds to a relatively long wavelength, the size and form factor of these antenna becomes cumbersome and often prohibitive for many applications.

Some investigations have attempted to solve this problem with a shorted discone antenna 65 as depicted in FIG. 3. Here, 'vias' are used to electrically short the disk to the cone at specific locations as 70 and 70'. Typically this shorting decreases the lowest operational frequency of the antenna. However, the gain does not improve from this technique.

Antenna systems that incorporate a Euclidean geometry include roof-mounted antennas that extend from objects such as residential homes or automobiles. Such extendable antennas can be susceptible to wind and other weather conditions and may be limited in bandwidth and frequency range. Additionally, by implementing a Euclidean geometry into these conformal antennas, antenna performance is degraded.

SUMMARY

In accordance with an aspect of the disclosure, an apparatus suitable for wideband transmission and reception and that may also me useful in environments susceptible to vibration and impact motion such as for example vehicles of various types, e.g., automobiles, trains, etc. The apparatus can include a bicone antenna portion (bicone antenna) including two cone-shaped elements (e.g., an accordioned bicone antenna). The physical shape of at least one of the two cone-shaped elements may be at least partially defined by one or more pleats (e.g., a series) that extend about a portion of the cone.

An antenna according to the present disclosure can further includes a mast for supporting the bicone as well as a second antenna section including a fractalized dipole. The fractalized dipole can be configured as a conformal circuit board conforming to the shape of the mast and can include self-similar portions or extensions. In one embodiment, the self-similar extensions may include two or more angular bends. The antenna may also include a counterpoise to balance the electrically conductive conformal portion. The counterpoise may be defined substantially by a repetitive tooth-like pattern. In exemplary embodiments, the antenna can be configured to transmit or receive electromagnetic energy between approximately 70 MHz and 3000 MHz. The counterpoise may include conductive attachments.

In exemplary embodiments of the system, a conductive epoxy may connect the electrical connector to the electrically conductive conformal portion of the antenna. The system may also include a transceiver that is connected to the electrical connector. The transceiver can include a low noise amplifier and/or a power amplifier. In exemplary embodiments, matching circuitry/components can be utilized, e.g., capacitors, RLC circuit(s), etc. across portions of the conformal circuit board. Additional tuning can optionally be augmented/facilitated by placement of tuning elements, e.g., capacitors, RLC circuitry, across the circuit board trace, forming a partial electrical trap.

In exemplary embodiments, the antenna can also incorporate a heat sink and/or a spring structure capable of sustaining road condition hits/bumps/vibrations. The tube structure can be internally supported, e.g., by a shaped foam, and/or externally applied to the mast structure.

Additional advantages and aspects of the present disclosure will become readily apparent to those skilled in the art from the following detailed description, wherein embodiments of the present invention are shown and described, simply by way of illustration of the best mode contemplated for practicing the present invention. As will be described, the present disclosure is capable of other and different embodiments, and its several details are susceptible of modification in various obvious respects, all without departing from the spirit of the present disclosure. Accordingly, the drawings and description are to be regarded as illustrative in nature, and not as limitative.

BRIEF DESCRIPTION OF THE DRAWINGS

Aspects of the disclosure may be more fully understood from the following which can be a cylinder, and/or may be applied to or supported by the outside surface of the mast. The tube structure can act as a mast for the accordioned bicone, which can be located at the top. Exemplary embodiments can provide operation across a 100:1 passband or greater, e.g., from HF (or MF) frequencies through microwave.

Figure 1:
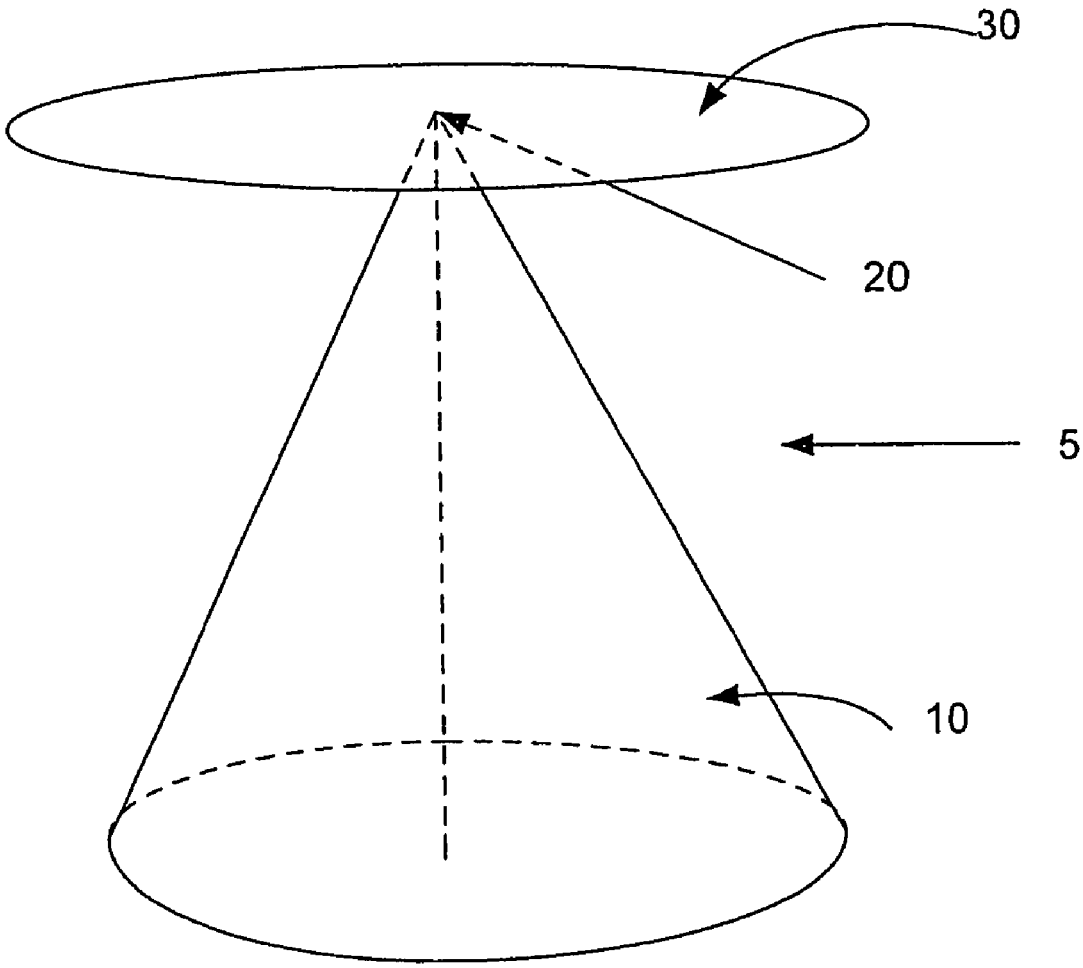
(PRIOR ART) FIG. 1

Antenna 400 can be fed by a main feed 450, which is shown splitting to (i) a bicone feed 460 leading to the center 456 of the accordioned bicone 410, and (ii) a dipole feed 462 feeding the fractalized dipole section 420. RLC matching circuitry may be used in exemplary embodiments.

Figure 4:
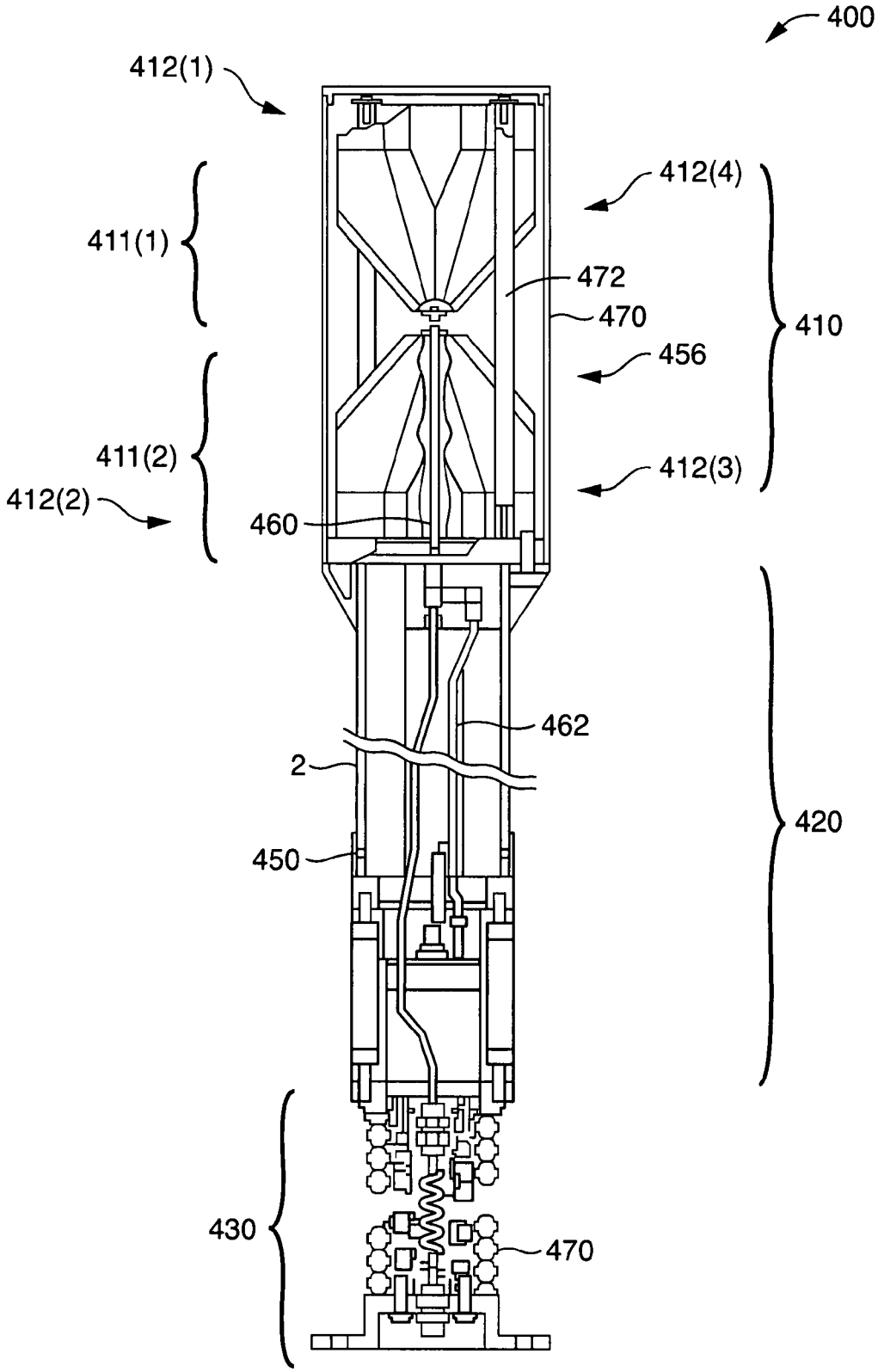
FIG. 4 depicts a cutaway diagram of an accordioned bicone antenna apparatus 400 according to an embodiment of the present disclosure. Antenna 400 includes an accordioned bicone 410 and a fractalized circuit board conformal to a cylinder acting as a mast section 420 to the bicone 410. Mast section 420 can include a conformal circuit board 450 that is configured to act as a fractalized dipole. The circuit board 450 includes one or more conductive portions or traces that include self-similar structure such as various suitable fractal shapes.

As further shown in FIG. 4, embodiments can include a base 430 with associated shock/motion compliance assembly 440 e.g., a spring, shock absorber, and/or dampener, that can be utilized to provide functionality suited for application of such antennas and systems to moving vehicles.

While the shaping techniques implemented in the bicone antenna 400 (shown in FIG. 4) utilize a pleat-shape in the conical portions and a fractal shape in/or the conformal portion, other geometric shapes, including one or more holes, can be incorporated into the antenna designs.

Figure 5:
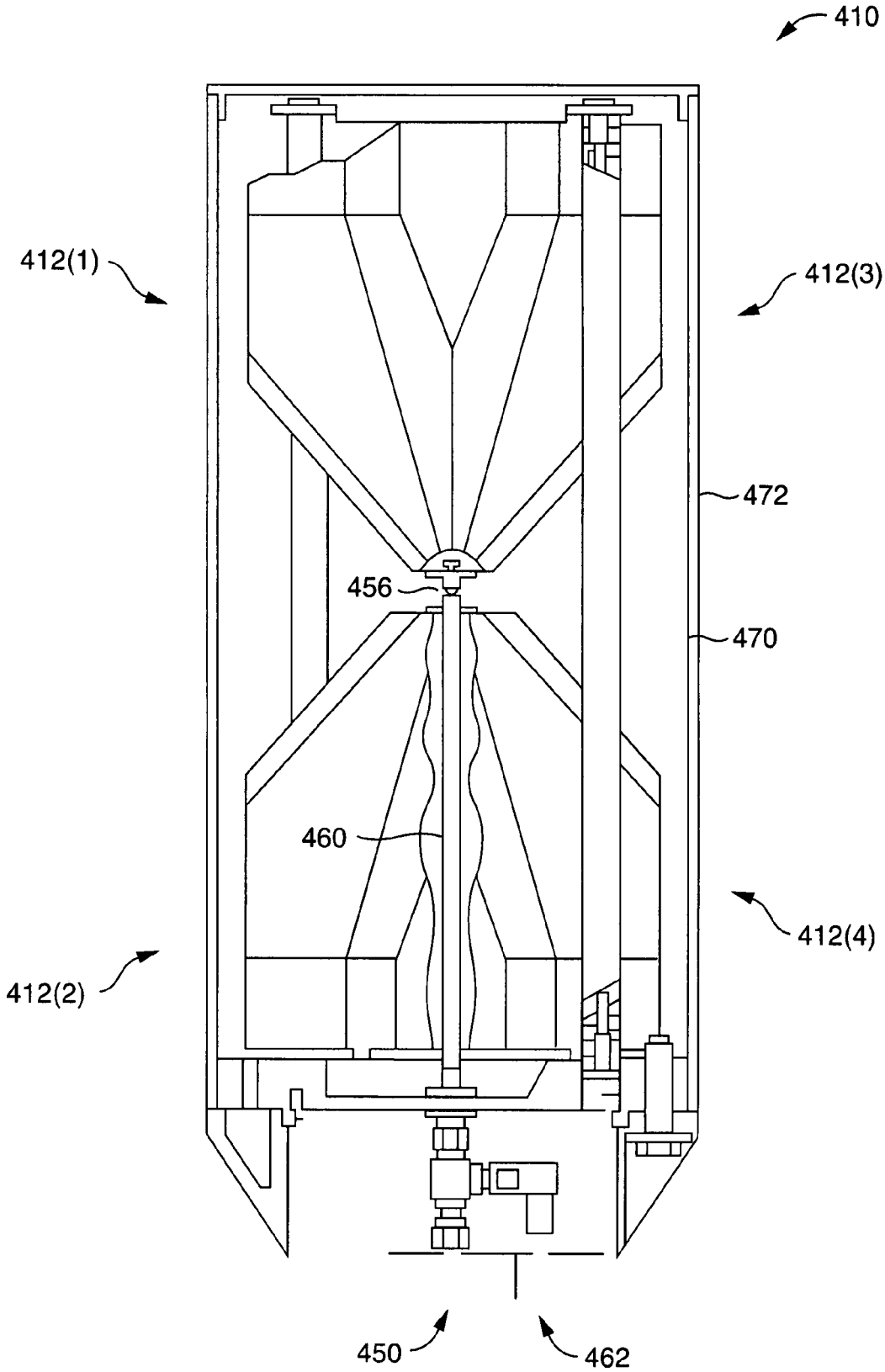

FIG. 5 depicts an enlarged view of the bicone assembly of FIG. 4 (and like numbers are referenced). Support poles 470 and outer sleeve 472 are also shown. Outers sleeve 472 (and also mast section 420) can act as RF transparent radomes.

Figure 2:
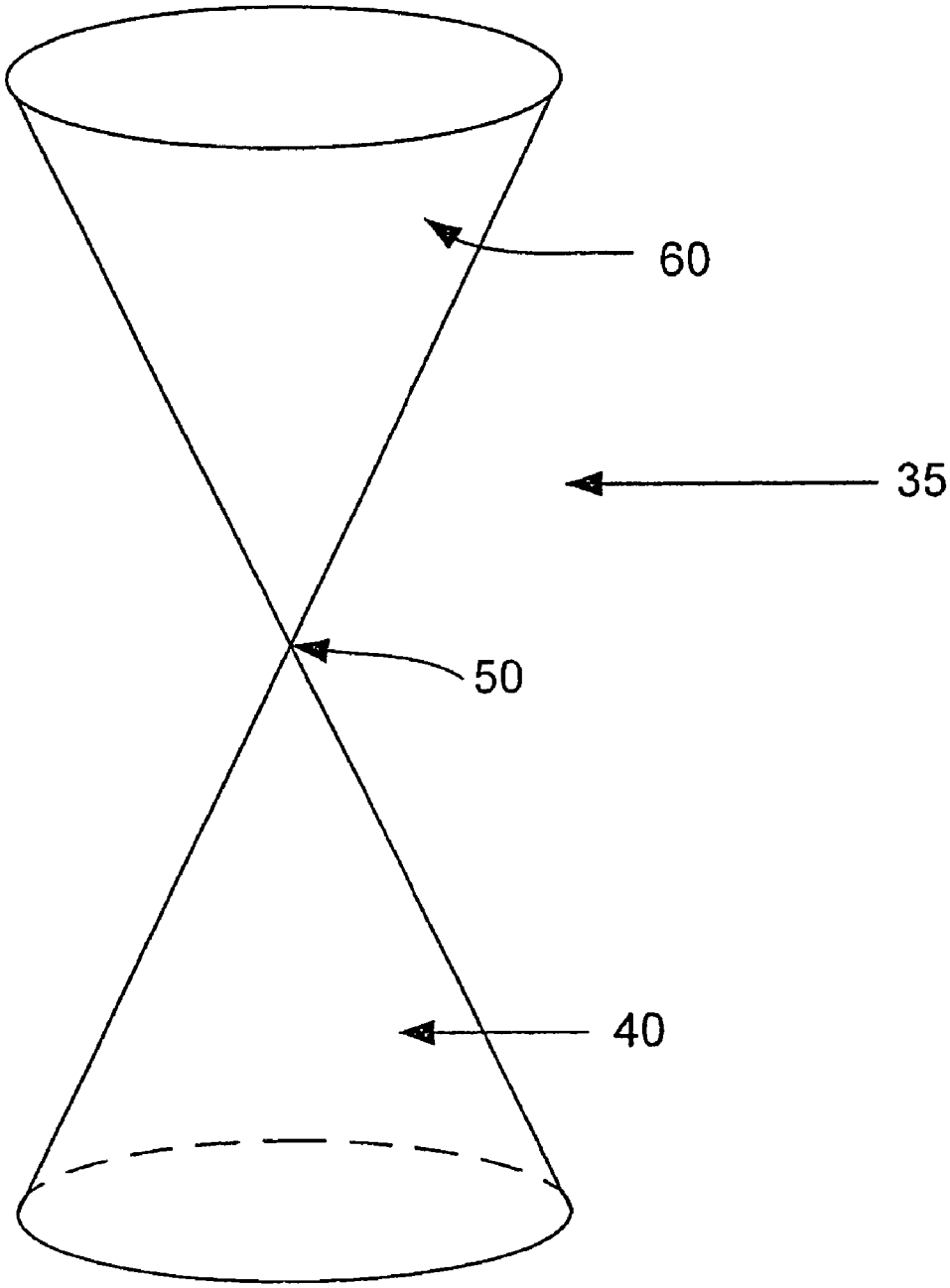
(PRIOR ART) FIG. 2
Figure 3:
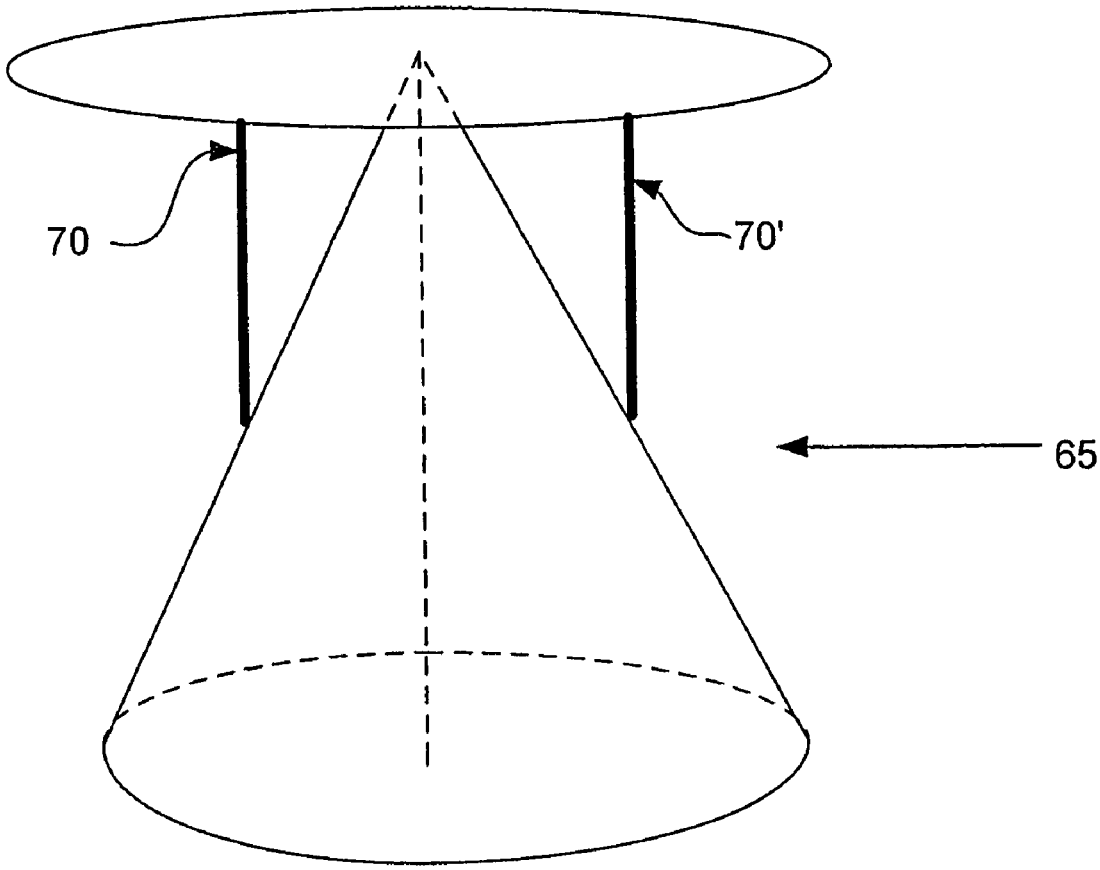
(PRIOR ART) FIG. 3

As can be seen from FIG. 5, by incorporating the pleat-shaping into the conical portions 411(1)-411(2), the bicone antenna 400 provides the frequency and beam-pattern performance of a larger sized bicone antenna that does not include shaping, such as in prior art bicone antennas (e.g., antenna 35 shown in FIG. 2).

With further reference to FIG. 5, each pleat of the bicone portion 410 can include two faces joined at a vertex having an included angle of less than 180 degrees as directed away from a principal axis of the cone-shaped element and/or antenna 400. In exemplary embodiments, the two faces of a pleat do not substantially overlap one another in a direction transverse to a bisector of the included angle. For certain embodiments, the faces and included angle for a pleat can be symmetrical; in other embodiments, the faces and includes angle are not symmetrical (e.g., can lie along the two sides of a non-Isosceles triangle.)

Figure 6:
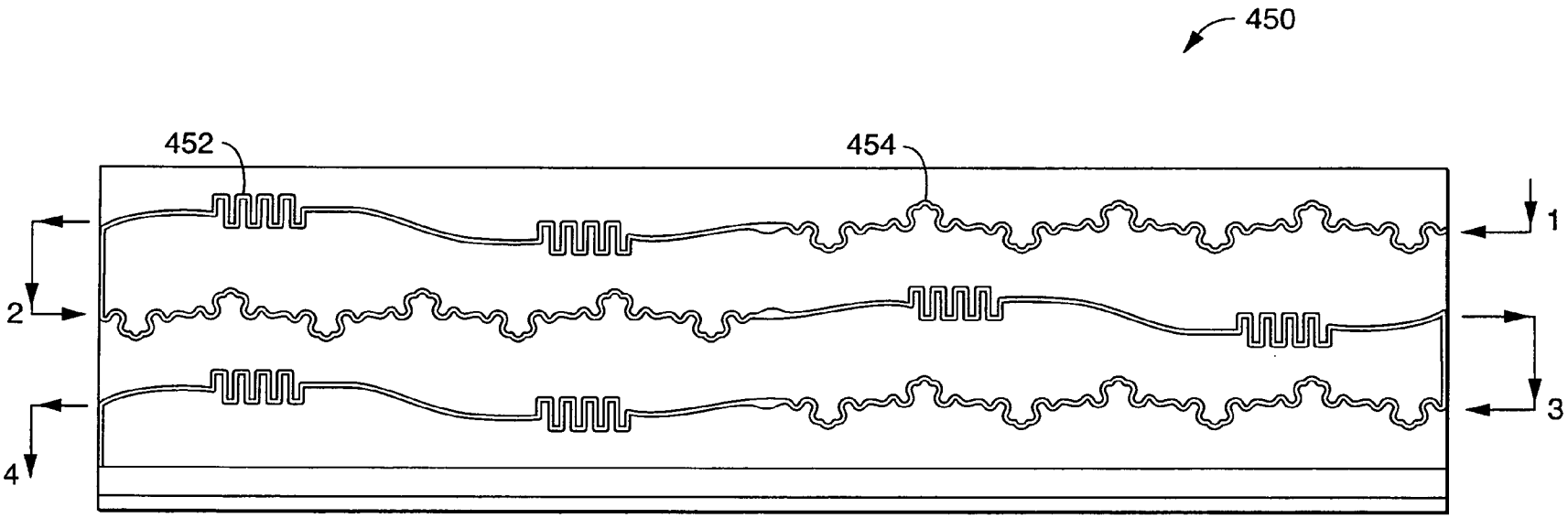

FIG. 6 depicts a conformal circuit board 450 used in embodiments of the present disclosure, e.g., as shown in FIG. 4. The conformal circuit board (or circuit) 450 includes one or more portions having a self-similar shape.

With continued reference to FIG. 6, the self-similar shape of the circuit board 450 can be defined as a fractal geometry. In general, fractal geometry may be grouped into random fractals (which can also be referred to as chaotic or Brownian fractals, and include a random noise component) or deterministic fractals. Fractals typically have a statistical self-similarity at all resolutions and are generated by an infinitely recursive process. For example, a so-called Koch fractal (shown as 454 in FIG. 6) may be produced with N iterations (e.g., N=1, N=2, etc.). One or more other types of fractal geometries may also be incorporated into the design to produce antenna 10. As shown, non-fractal portion(s) 452 (such as sawtooth patterns) can be utilized in conjunction with fractal portion(s) 454. Such patterns, e.g., 452, can be utilized as a counterpoise.

In exemplary embodiments, as also shown in FIG. 6, at least a portion of the conductive trace(s) of circuit board 450 is not required to be center-fed. An example of a top-right feed configuration is shown, with a current path indicated from 1 through 4 in the directions of the arrows (which obviously alternate with changes in current).

By incorporating the fractal geometry into the electrically conductive and non-conductive portions of circuit board 450, the length and width (e.g., and consequently, electrical size) of the conductive and non-conductive portions of the antenna (e.g., 400 of FIG. 4) is increased due to the nature of the fractal pattern. While the lengths and widths increase, however, the overall footprint area of circuit board (fractalized dipole) 450 is relatively small. By providing longer conductive paths, dipole 450 (and, consequently, the related antenna 400) can perform over a broad frequency band.

Figure 7:
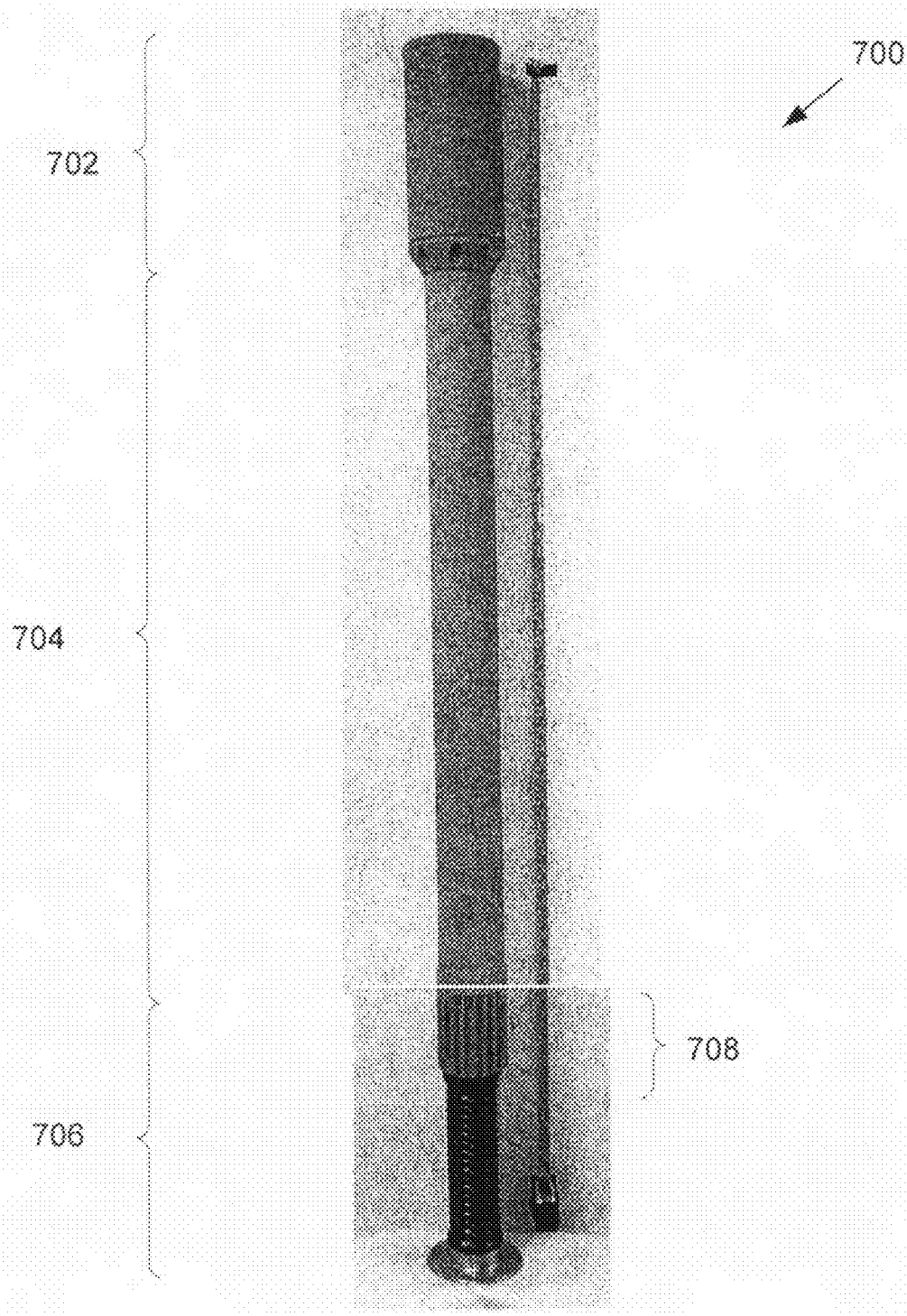

FIG. 7 is a picture of an exemplary embodiment of an antenna 700 constructed in accordance with the present disclosure. Bicone section 702 with housing is shown configured on top of mast section 704. Mast section 704 in turn is configured on top of base 706, which include a spring for motion control and heat shield 708, which can dissipate thermal energy, such as caused by resisitive heating. A tape measure is shown for scale.

In operation of antennas according to the present disclosure (e.g., antenna 400 of FIG. 4), the fractalized dipole (e.g., associated with mast 420 of FIG. 4) can operate from the lowest frequencies of operation to the lower frequency cutoff of the bicone section 410. The entire antenna can be fed by a single feed that can be configured up the middle of the tube, connecting to the bicone, and then being routed down to the circuit board as an off center dipole.

In exemplary embodiments, matching circuitry/components can be utilized, e.g., capacitors, RLC circuit(s), etc. Additional tuning can optionally be augmented/facilitated by placement of tuning elements, e.g., capacitors, inductors, and/or RLC circuitry, across the circuit board trace(s), forming a partial electrical trap. In further exemplary embodiments, the antenna can also incorporate a heat sink and/or a spring/shock absorbing structure capable of sustaining road condition hits/bumps/vibrations. The tube/mast structure can be internally supported by a shaped foam (e.g., foam pipe insulation). Alternatively or supplementally, the conformal circuit board may be configured on the outside surface of the mast portion, e.g., as applied with adhesive or other bonding structure/chemicals.

While certain embodiments have been described herein, it will be understood by one skilled in the art that the methods, systems, and apparatus of the present disclosure may be embodied in other specific forms without departing from the spirit thereof. For example, while Accordingly, the embodiments described herein are to be considered in all respects as illustrative of the present disclosure and not restrictive.

What is claimed is:

1. An apparatus comprising:

a bicone antenna including two cone-shaped elements, the physical shape of at least one of which is at least partially defined by at least one pleat, wherein each pleat includes two faces joined at a vertex having an included angle of less than 180 degrees as directed away from a principal axis of the cone-shaped element;

a mast configured to support the bicone antenna; and a conformal circuit board configured to conform to a surface of the mast, wherein the conformal circuit board includes an electrically conductive conformal portion defined in part self-similar extensions and an electrically non-conductive conformal portion.

2. An apparatus according to claim 1, wherein the two faces of the pleat do not substantially overlap one another in a direction transverse to a bisector of the included angle.

3. The apparatus of claim 1, wherein the physical shape of one of the two cone-shaped elements is at least partially defined by at least one hole.

4. The apparatus of claim 1, wherein the physical shape of one of the two cone-shaped elements is at least partially defined by a series of pleats that extend about a portion of the cone.

5. The antenna of claim 1, wherein the self-similar extensions include two or more angular bends.

6. The antenna of claim 1, further comprising:

a counterpoise to balance the electrically conductive conformal portion.

7. The antenna of claim 1, further comprising:

a counterpoise is defined substantially by a repetitive tooth-like pattern.

8. The antenna of claim 7, wherein the counterpoise includes conductive attachments.

9. The antenna of claim 1, wherein the antenna is configured to transmit electromagnetic energy between approximately 70 MHz and 3000 MHz.

10. The antenna of claim 1, wherein the antenna is configured to receive electromagnetic energy between approximately 70 MHz and 3000 MHz.

11. The antenna of claim 1, wherein the electrically conductive portion is mounted to a substrate that includes polyethylene terephthalate (PET).

12. The antenna system of claim 1, further comprising:

a transceiver connected to the antenna.

13. The antenna system of claim 12, wherein the transceiver includes a low noise amplifier.

14. The antenna system of claim 13, wherein the transceiver includes a power amplifier.

* * * * *